US008681186B2

(12) United States Patent
Park

(10) Patent No.: US 8,681,186 B2
(45) Date of Patent: Mar. 25, 2014

(54) DATA DRIVER AND ORGANIC LIGHT EMITTING DISPLAY HAVING THE SAME

(75) Inventor: Jung-Kook Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 782 days.

(21) Appl. No.: 12/858,363

(22) Filed: Aug. 17, 2010

(65) Prior Publication Data

US 2011/0050749 A1 Mar. 3, 2011

(30) Foreign Application Priority Data

Aug. 27, 2009 (KR) ..... 10-2009-0079791

(51) Int. Cl.

| | |
|---|---|
| ***G09G 5/10*** | (2006.01) |
| ***G09G 3/30*** | (2006.01) |
| ***G09G 5/00*** | (2006.01) |

(52) U.S. Cl.

USPC ..... 345/690; 345/78; 345/204

(58) Field of Classification Search

USPC ..... 345/100, 205, 690, 208, 211, 204, 212, 345/78

See application file for complete search history.

(56) References Cited

U.S. PATENT DOCUMENTS

| | | | | |
|---|---|---|---|---|
| 8,115,755 | B2 * | 2/2012 | Chia | 345/211 |
| 2007/0182693 | A1 * | 8/2007 | Kwon et al. | 345/100 |
| 2008/0100603 | A1 * | 5/2008 | Matsuda et al. | 345/205 |
| 2010/0134528 | A1 * | 6/2010 | Kim et al. | 345/690 |

FOREIGN PATENT DOCUMENTS

| | | | |
|---|---|---|---|
| JP | 2000-039870 | | 2/2000 |
| JP | 2007-010871 | | 1/2007 |
| JP | 2008-116556 | | 5/2008 |
| JP | 2009-187035 | | 8/2009 |
| KR | 10-0438785 | | 7/2004 |
| KR | 10-2005-0019172 | | 3/2005 |
| KR | 10-2007-0038584 | A | 4/2007 |
| KR | 10-2007-0070818 | A | 7/2007 |
| KR | 10-2007-0077759 | A | 7/2007 |
| KR | 10-0740101 | B1 | 7/2007 |
| KR | 10-0750918 | | 8/2007 |

OTHER PUBLICATIONS

KIPO Office Action dated Oct. 28, 2011, for Korean Priority Patent Application No. 10-2009-0079791, citing the references in this IDS, as well as KR 10-0740101 B1 and KR 10-2005-0019172 A, both of which were cited in an IDS dated Mar. 23, 2011, 2 pages.

(Continued)

*Primary Examiner* — Kent Chang
*Assistant Examiner* — Nelson Rosario
(74) *Attorney, Agent, or Firm* — Christie, Parker & Hale, LLP

(57) ABSTRACT

A data driver and an organic light emitting display having the same. The data driver has a switch unit provided between output terminals of respective output buffers that are provided in the data driver and data lines corresponding thereto. Here, the switch unit is also coupled to a source for providing a middle voltage, and allows the output terminals of the output buffers to be coupled to receive the middle voltage before data signals are output from the data driver by the operation of the switch unit, making it possible to improve the slew rate of the output buffer and to reduce power consumption, and an organic light emitting display having the same. The switch unit may includes a first switch coupled between the source for providing the middle voltage and the output terminals, and a second switch coupled between the output terminals and the respective data lines.

13 Claims, 6 Drawing Sheets

(56) References Cited

OTHER PUBLICATIONS

KIPO Office action dated Feb. 17, 2011, for Korean priority Patent application 10-2009-0079791, noting listed references in this IDS.

Korean Patent Abstracts, Publication No. 10-2007-00279962, dated Mar. 12, 2007, corresponds to Korean Patent KR 10-0740101 listed above.

Office action dated Feb. 7, 2012 issued in corresponding Japanese Patent Application No. 2009-255304; 2pp.

Japanese Office action dated May 29, 2012, for corresponding Japanese Patent application 2009-255304, (2 pages).

* cited by examiner

DATA DRIVER AND ORGANIC LIGHT EMITTING DISPLAY HAVING THE SAME

CROSS-REFERENCE TO RELATED APPLICATION

This application claims priority to and the benefit of Korean Patent Application No. 10-2009-0079791, filed on Aug. 27, 2009, in the Korean Intellectual Property Office, the entire content of which is incorporated herein by reference.

BACKGROUND

1. Field

An embodiment of the present invention relates to a data driver, and more particularly, to a data driver that controls the slew rate of an output buffer provided in the data driver and an organic light emitting display having the same.

2. Description of Related Art

Recently, various flat panel displays that are light in weight and smaller in volume than that of an equivalent cathode ray tube, have been developed. Here, a flat panel display can be a liquid crystal display, a field emission display, a plasma display panel, a light emitting display, etc.

A flat panel display typically includes a display panel, a scan driver, and a data driver. The scan driver outputs scan driving signals sequentially to a plurality of scan lines formed on the display panel, and the data driver outputs R, G, and B image signals to the data lines of the display panel.

Here, the respective image signals output from the data driver are amplified at a set or predetermined level through output buffers to be output to the data lines of the display panel.

FIG. 1 is a perspective diagram showing one example of an operational amplifier that constitutes an output buffer provided in a data driver of a related art.

The output buffer 10 shown in FIG. 1 has a folded cascade operational amplifier circuit 11 having a rail to rail input terminal structure and an output circuit 12 having a common drain amplifier and a compensation capacitor C.

The folded cascade operational amplifier circuit 11 amplifies the difference of signals between a first input terminal Vin+ terminal and a second input terminal Vin− terminal, and the output circuit 12 amplifies and outputs the signals output from the folded cascade operational amplifier circuit 11.

The folded cascade operational amplifier circuit 11 has a PMOS current bias circuit 13 and an NMOS current bias circuit 14. Herein, the PMOS current bias circuit 14 has a PMOS transistor MP1, wherein the PMOS transistor MP1 is driven by bias voltage $V_{BP}$ generated from a bias voltage generator to supply bias current $I_{BP1}$ to the folded cascade operational amplifier circuit 11.

Moreover, the NMOS current bias circuit 14 has an NMOS transistor MN1, wherein the NMOS transistor NM1 is driven by bias voltage $V_{BN}$ generated from the bias voltage generator to supply bias current $I_{BN1}$ to the folded cascade operational amplifier circuit 11.

The slew rate of the output of the output buffer 10 may be represented by $$\frac{I_{BN} - I_{BP1}}{2C}.$$

Here, the slew rate refers to maximum variation of the output voltage per unit time, that is, the slew rate refers to the instant slope (=value differentiated for time) of the output voltage when describing the output voltage using a graph for time.

In the data driver provided in a display, many characteristics are determined by the output buffer that outputs driving voltage to a display panel, wherein the slew rate of the output buffer among these characteristics have a great influence on the driving current of the data driver.

In particular, when demux Demux is used for the reduction in input time due to the larger panel size of the modern display and/or for the reduction in costs by reducing the size of the driver IC of the display, there is a demand for the reduction in the slew rate of the output buffer.

However, in the related art, the slew rate of the output signal output from the data driver depends on the bias current $I_{BP1}$ and $I_{BN1}$ of the output buffer and the compensation capacitor C, which limit how much the slew rate can be reduced.

SUMMARY

An embodiment of the present invention is directed toward a data driver and an organic light emitting display having the same. The data driver has a switch unit provided between output terminals of respective output buffers (that are provided in the data driver) and data lines corresponding thereto. Here, the switch unit is also coupled to a source for providing a middle voltage VM, VM', and allows the output terminals of the output buffers to be coupled to receive the middle voltage VM, VM' before data signals are output from the data driver by the operation of the switch unit, making it possible to improve the slew rate of the output buffer and to reduce power consumption.

According to an embodiment, there is provided a data driver including: an amplifier including respective output buffers corresponding to respective data lines, the respective output buffers being configured to output data signals to the respective data lines; and a switch unit between output terminals of the respective output buffers provided for the data lines and the respective data lines corresponding thereto. Here, the switch unit includes a first switch coupled between a source for providing a middle voltage and the output terminals of the respective output buffers; and a second switch coupled between the output terminals of the respective output buffers and the respective data lines corresponding thereto.

In one embodiment, the data driver further includes: a shift register unit configured to generate shift register clocks to provide sampling signals; a sampling latch unit configured to sequentially store data in response to the sampling signals supplied sequentially from the shift register unit; a holding latch unit configured to receive the data latched in the sampling latch unit and to store the latched data; and a digital-analog converter configured to generate the data signals as analog gray scale voltages corresponding to bit values of the data.

In one embodiment, the first switch is configured to be turned on before the data signals are output to the respective data lines so that the output terminals of the output buffers are coupled to receive the middle voltage, and the second switch is configured to be turned on when the data signals are output so that the output terminals of the output buffers are coupled to the data lines corresponding thereto.

In one embodiment, the middle voltage is ½ of a maximum swing voltage of the data signals implemented as a plurality of gray scale voltages. Here, the middle voltage may be ½ of the sum of the gray scale voltage at 0 gray scale level and the gray scale voltage at the maximum gray scale level, among the plurality of gray scale voltages; or the middle voltage may be implemented as ½ value of an uppermost level voltage of a ladder resistor in a gamma correction unit; or the middle voltage may be implemented by comparing ½ of the sum of the gray scale voltage at 0 gray scale level and the gray scale voltage at the maximum gray scale level, among the plurality of gray scale voltages, with a middle gray scale voltage of the gray scale voltages from 0 gray scale voltage to the entirety thereof, among the plurality of gray scale voltages and selecting the gray scale voltage closest to the ½ of the sum of the gray scale voltage at 0 gray scale level and the gray scale voltage at the maximum gray scale level; or the middle voltage may be implemented by comparing ½ of an uppermost level voltage of a ladder resistor in a gamma correction unit with a middle gray scale voltage of the gray scale voltages from 0 gray scale voltage to the entirety thereof, among the plurality of gray scale voltages, and selecting the gray scale voltage closest to the ½ of the uppermost level voltage.

According to an embodiment, there is provided an organic light emitting display including: a display panel including a plurality of scan lines arranged to extend in a first direction and configured to transfer scan signals, a plurality of data lines arranged to extend in a second direction crossing the first direction and configured to transfer data signals, and a plurality of pixel circuits that are coupled to the scan lines and the data lines; a data driver configured to generate the data signals and to apply them to the data lines; a gamma correction unit configured to generate a plurality of gray scale voltages to provide them to the data driver; and a middle voltage generator configured to generate a middle voltage by selecting a specific gray scale voltage among the plurality of gray scale voltages output from the gamma correction unit. Here, the data driver includes: an amplifier including respective output buffers corresponding to the respective data lines, the respective output buffers being configured to output the data signals to the respective data lines; and a switch unit between output terminals of the output buffers and the data lines and is configured to receive a voltage corresponding to the middle voltage.

In one embodiment, the switch unit includes a first switch coupled between the middle voltage generator and the output terminals of the respective output buffers; and a second switch coupled between the output terminals of the respective output buffers and the respective data lines corresponding thereto. The first switch may be configured to be turned on before the data signals are output to the respective data lines so that the output terminals of the output buffers are coupled to receive the middle voltage, and the second switch may be configured to be turned on when the data signals are output so that the output terminals of the output buffers are coupled to the data lines corresponding thereto.

In one embodiment, the middle voltage generator is configured to select the gray scale voltage at 0 gray scale level and the gray scale voltage at the maximum gray scale level, among the plurality of gray scale voltages, to generate ½ of the sum thereof as the middle voltage.

In one embodiment, the organic light emitting display further includes: a comparator configured to receive and compare the middle voltage generated from the middle voltage generator and a middle gray scale voltage of the gray scale voltages from 0 gray scale voltage to the entirety thereof, among the plurality of gray scale voltages output from the gamma correction unit, to select the gray scale voltage closest to the middle voltage and to provide it to the data driver.

With the embodiments as described above, the switch unit is provided between the output terminals of the respective output buffers provided in the data driver and the data lines corresponding thereto and is coupled to receive the middle voltage. As such, the output terminals of the output buffers can be coupled to receive the middle voltage before the data signals are output from the data driver by the operation of the switch unit. Thereby, the slew rate of the output buffer is improved, and the power consumption is reduced.

Moreover, because the slew rate is improved, it is possible to reduce the size of the data driver IC.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION

Figure 1:
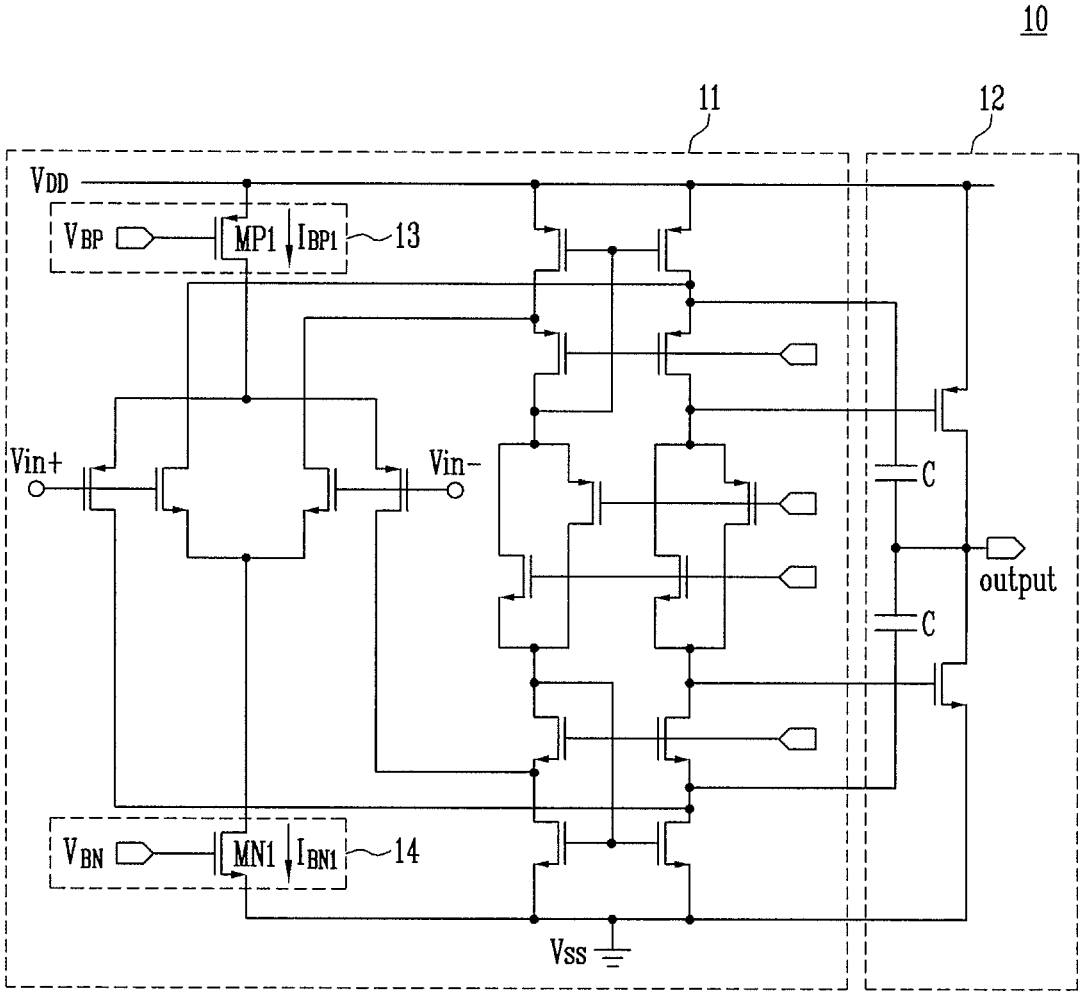
FIG. 1 is a perspective diagram showing one example of an operational amplifier that constitutes an output buffer provided in a data driver of a related art.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via one or more third elements. Further, some of the elements that are not essential to the complete understanding of the invention are omitted for clarity. Also, like reference numerals refer to like elements throughout.

Hereinafter, exemplary embodiments of the present invention will be described in more detail with reference to the accompanying drawings.

Figure 2:
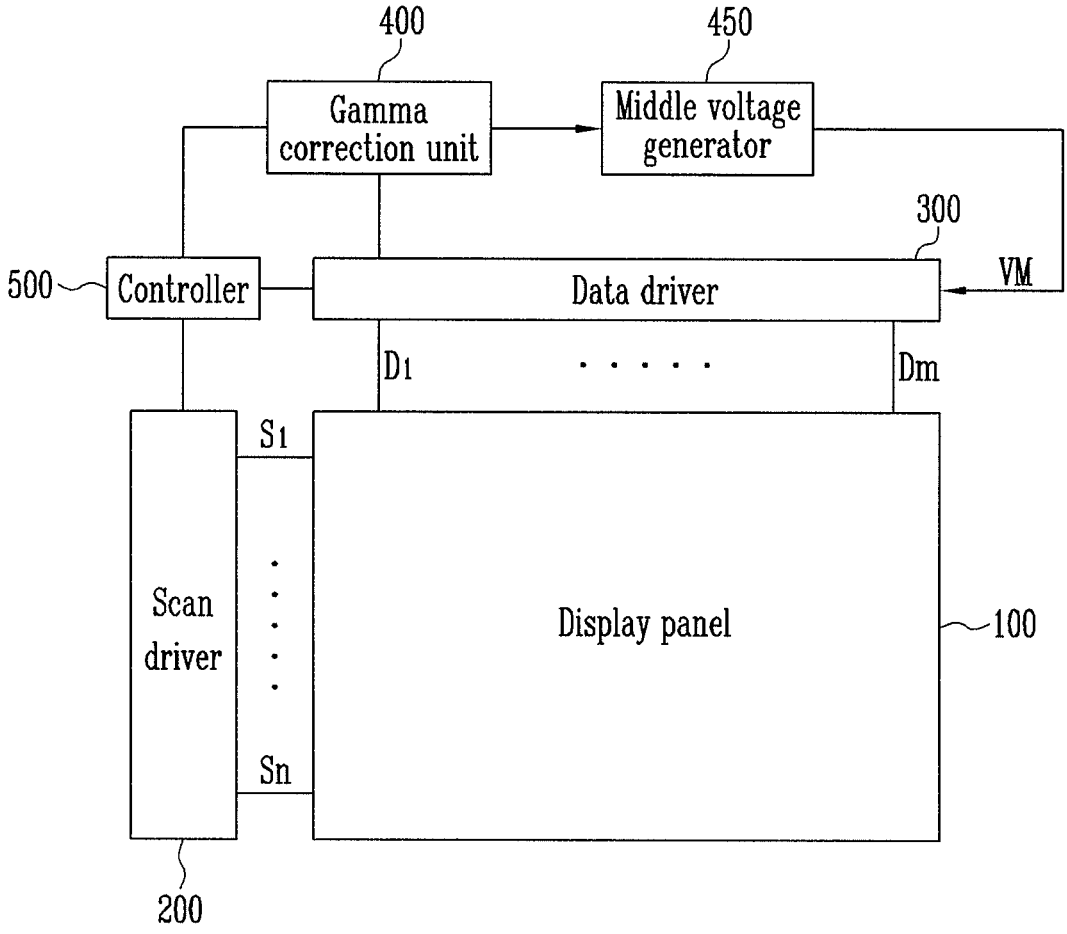
FIG. 2 is a perspective block diagram showing the constitution of an organic light emitting display according to an embodiment of the present invention.

FIG. 2 is a perspective block diagram showing the constitution of an organic light emitting display according to an embodiment of the present invention.

Referring to FIG. 2, the organic light emitting display includes a display panel 100, a scan driver 200, a data driver 300, a gamma correction unit 400, a middle voltage generator 450, and a controller 500.

The display panel 100 includes a plurality of data lines D1-Dm that are extended in a column direction, a plurality of scan lines S1-Sn that are extended in a row direction, and a plurality of pixels. The data lines D1-Dm transfer data signals representing image signals to the pixels, and the scan lines S1-Sn transfer selection signals to the pixels. Also, each pixel, which is formed in a pixel region defined by two neighboring data lines D1-Dm and two neighboring scan lines S1-Sn, includes a switching transistor, a driving transistor, and an organic EL device (e.g., an organic light emitting diode or OLED).

The scan driver 200 receives control signals including start signals, clock signals, etc. from the controller 500 to sequentially generate and apply scan signals to the respective scan lines S1-Sn.

The data driver (data driving circuit) 300 receives signals such as image signals, start signals, clock signals, etc. from the controller 500 to apply data voltage corresponding to the image signals to the data lines D1-Dm.

However, in one embodiment of the present invention, a switch unit for applying a middle voltage VM is provided between the output terminals of the respective output buffers provided in the data driver 300 and the respective data lines D1-Dm, wherein the output terminal of the output buffer is implemented to apply the middle voltage VM before the data signal is output from the data driver 300 by the operation of the switch unit. Thereby, the slew rate of the output buffer can be improved, and the power consumption can be reduced.

The detailed constitution of the data driver 300 as described above and the operation thereof will be described in more detail with reference to FIGS. 4 to 6.

Moreover, the gamma correction unit 400 performs a gamma correction on the image signals to be input and then, generates gray scale voltages corresponding to each gray scale level (gray level) therethrough to transfer them to the data driver 300.

However, in one embodiment of the present invention, the middle voltage generator 450 is included to generate the middle voltage VM by selecting a specific gray scale voltage among a plurality of gray scale voltages output from the gamma correction unit 400 and transfer it to the data driver 300.

Here, the middle voltage VM generated from the middle voltage generator 450 may be implemented as ½ value of the sum of V0 that is the gamma voltage at 0 gray scale level and V255 that is the gamma voltage at 255 gray scale level, of the plurality of gray scale voltages output from the gamma correction unit 400, or may be implemented as ½ value of a uppermost level voltage VREGOUT, as will be described in more detail below.

Moreover, the organic EL device (OLED) provided in the respective pixels, whose cathode is coupled to a reference voltage Vss, emits light corresponding to the current applied through a driving transistor. Here, as the voltage Vss coupled to the cathode of the organic EL device, the ground voltage (or any other suitable voltage), may be used.

Figure 3:
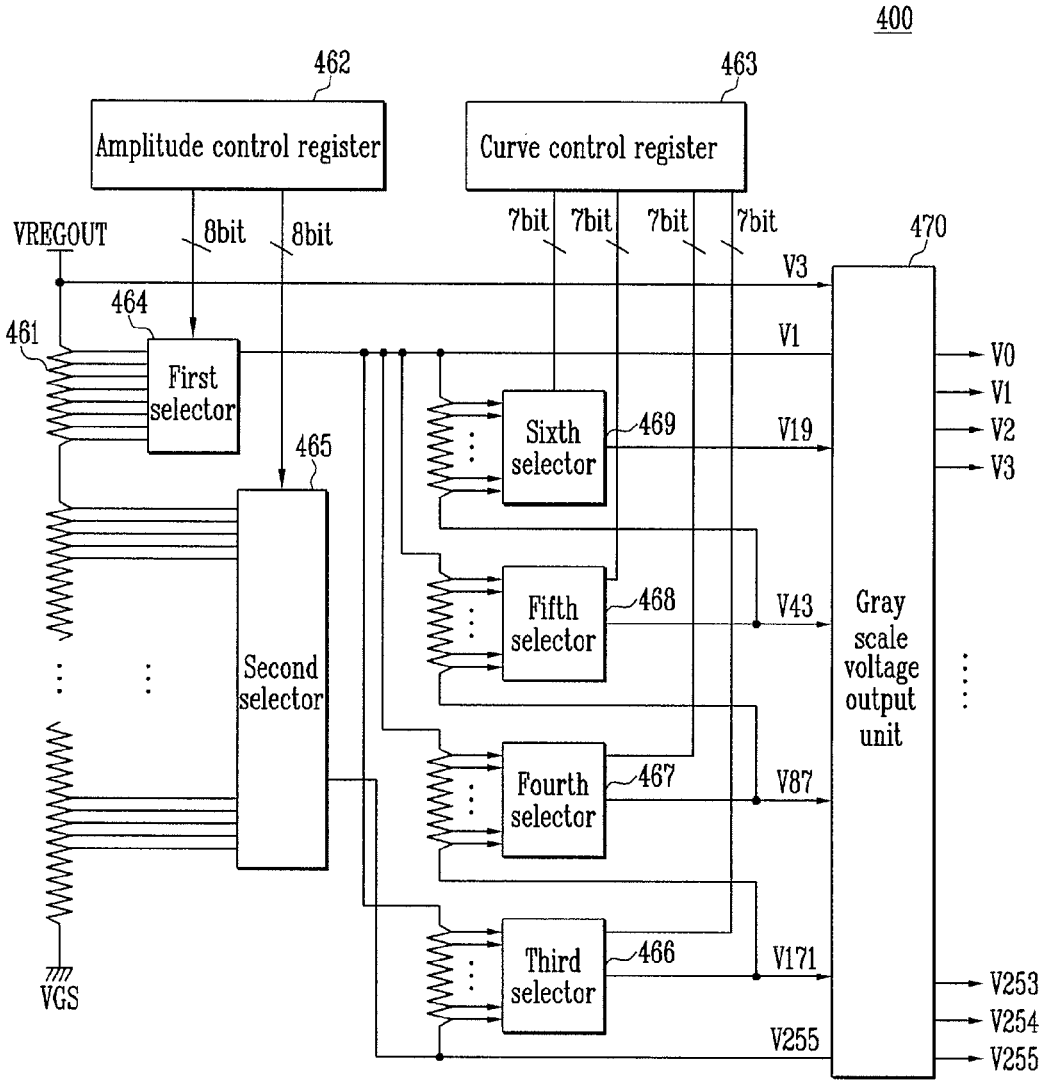
FIG. 3 is a perspective block diagram showing the constitution of a gamma correction unit of FIG. 2 according to an embodiment of the present invention.

FIG. 3 is a perspective block diagram showing the constitution of the gamma correction unit 400 of FIG. 2.

However, this is merely one embodiment, and the constitution of the gamma correction unit 400 of the present invention is not limited thereto.

Referring to FIG. 3, the gamma correction unit 400 operates by including a ladder resistor 461, an amplitude control register 462, a curve control register 463, a first selector 464, a second selector 465, a third selector 466, a fourth selector 467, a fifth selector 468, a sixth selector 469, and a gray scale voltage output unit 470.

The ladder resistor 461 has a constitution where the uppermost level voltage VREGOUT supplied from the outside is set as a reference voltage and a plurality of variable resistors included between the lowest level voltage VGS and the reference voltage are coupled in series, such that a plurality of gray scale voltages are generated through the ladder resistor 461. Also, when the value of the ladder resistor 461 is small, the amplitude adjustment range becomes narrow but the adjustment precision improves. To the contrary, when the value of the ladder resistor 461 is large, the amplitude adjustment range becomes wide but the adjustment precision lowers.

The amplitude control register 462 outputs 8-bit register set value to the first selector 464 and outputs 8-bit register set value to the second selector 465. Here, the number of gray scale levels (gray levels) to be selectable may be increased by increasing the number of set bits and the gray scale voltages may be differently selected by changing the register set values.

The curve control register 463 outputs 7-bit register set value to each of the third selector 466 through the sixth selector 469. Here, the register set values may be changed and the gray scale voltages to be selectable may be controlled according to the register set values.

That is, initially, the uppermost level voltage of the ladder resistor 461 is output as the uppermost gray scale voltage V0, and the first selector 464 selects the gray scale voltage corresponding to the 8-bit register set value set in the amplitude control register 462, among the plurality of gray scale voltages distributed by the ladder resistor 461, to output it as the uppermost gray scale voltage, that is, V1.

The second selector 465 selects the gray scale voltage corresponding to the 8-bit register set value set in the amplitude control register 462, among the plurality of gray scale voltages distributed by the ladder resistor 461, to output it as the lowest gray scale voltage.

The third selector 466 distributes the voltage between the gray scale voltage output from the first selector 464 and the gray scale voltage output from the second selector 465 to the plurality of gray scale voltages through a plurality of resistor strings and selects and outputs the gray scale voltage corresponding to 7-bit register set value.

The fourth selector 467 distributes the voltage between the gray scale voltage output from the first selector 464 and the gray scale voltage output from the third selector 466 through a plurality of resistor strings and selects and outputs the gray scale voltage corresponding to the 7-bit register set value.

The fifth selector 468 selects and outputs the gray scale voltage corresponding to the 7-bit register set value, among the gray scale voltages between the first selector 464 and the fourth selector 467.

The sixth selector 469 selects and outputs the gray scale voltage corresponding to the 7-bit register set value, among the plurality of gray scale voltages between the first selector 464 and the fifth selector 468. The curve adjustment of the middle gray scale unit can be performed according to the register set values of the curve control register 463 through the operations as described above, making it possible to facilitate the adjustment of the gamma characteristics conforming to the respective characteristics of the organic EL device (OLED).

Moreover, the resistance values of the respective ladder resistors 461 are set in the manner that in order to make the gamma curve characteristics bulge downward, the potential difference among the respective gray scale levels is set to be large as the small gray scale level is displayed, whereas, in order to make the gamma curve characteristics bulge upward, the potential difference among the respective gray scale levels is set to be small as the small gray scale level is displayed.

In other words, with the gamma correction unit 400 of FIG. 3, the gray scale voltages corresponding to the total of 255 gray scale levels of V0 to V255 can be output.

Figure 4:
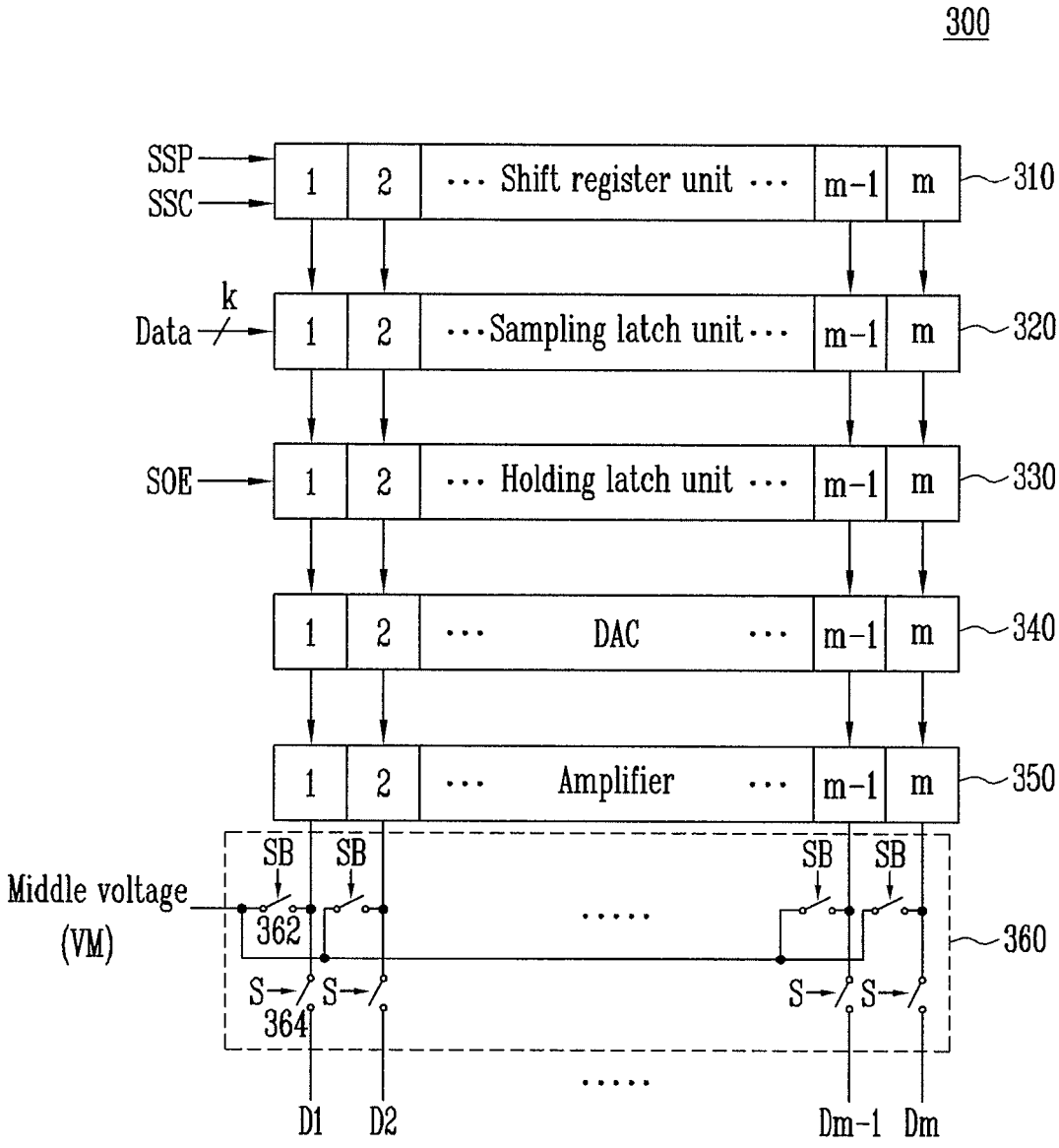
FIG. 4 is a perspective block diagram showing the constitution of a data driver of FIG. 2 according to an embodiment of the present invention.

FIG. 4 is a perspective block diagram showing the constitution of the data driver 300 of FIG. 2.

Referring to FIG. 4, the data driver 300 includes a shift register unit 310, a sampling latch unit 320, a holding latch unit 330, a digital-analog converter (DAC) 340, an amplifier 350, and a switch unit 360.

The shift register unit 310 receives a source shift clock SSC and a source start pulse SSP from a timing controller, and generates m sampling signals sequentially, while shifting the source start pulse SSP for each first period of the source shift clock SSC. To this end, the shift register unit 310 has m shift registers.

The sampling latch unit 320 sequentially stores data Data in response to the sampling signals supplied sequentially from the shift register unit 310. Here, the sampling latch unit 320 has m sampling latches in order to store m digital data Data. In addition, the respective sampling latches have the size corresponding to the bit number of the data Data. For example, when the data Data are constituted in k bit, the respective sampling latches are set to the size of k bit.

When a source output enable SOE signal is input, the holding latch unit 330 receives and stores the data Data from the sampling latch unit 320. Also, when the source output enable SOE signal is input, the holding latch unit 330 supplies the data Data stored in itself to the DAC 340. Here, the holding latch unit 330 has m holding latches in order to store m data Data. Also, the respective holding latches have the size corresponding to the bit number of the data Data. For example, the respective holding latches are set to k bit so that the data Data can be stored.

The DAC 340 generates an analog signal corresponding to the bit value of the input digital data Data, wherein the DAC selects any one of a plurality of gray scan voltages output from the gamma correction unit 400 of FIG. 3 by corresponding to the bit value of the data Data supplied from the holding latch unit 330, thereby generating the analog data signal corresponding thereto.

The amplifier 350 amplifies the digital data converted into the analog signal in the DAC 340 at a set or predetermined level to output it to the respective data lines D1 to Dm provided in the panel. To this end, the amplifier 350 has m output buffers to correspond to each of the m data lines.

Moreover, one embodiment of the present invention includes a switch unit 360 provided between the output terminal of the respective output buffers provided for each channel of the amplifier 350, that is, for each data line, and the respective data lines D1-Dm corresponding thereto.

The switch unit 360 has a pair of switches 362 and 364 for each channel, wherein the first switch 362 is coupled between a source for providing the middle voltage VM and the output terminals of the respective output buffers provided for each channel of the amplifier 350, and the second switch 364 is coupled between the output terminals and the data lines corresponding thereto.

In the embodiment of the present invention, before the data signal is output from the data driver by the operation of the switch unit 360, the first switch 362 is turned on so that the output terminals of the output buffers are coupled to receive the middle voltage VM, and when the data signal is output, the second switch 364 is turned on so that the output terminals of the output buffers are coupled to the respective data liens corresponding thereto. Thereby, the slew rate of the output buffer can be improved and further power consumption can be reduced.

Herein, the middle voltage VM, which is ½ of the maximum swing voltage of the data voltage, is exemplarily implemented as the middle voltage VM of the plurality of gray scale voltages discussed above through FIG. 3. The specific implemented example of the middle voltage VM will be described in more detail below.

Figure 5:
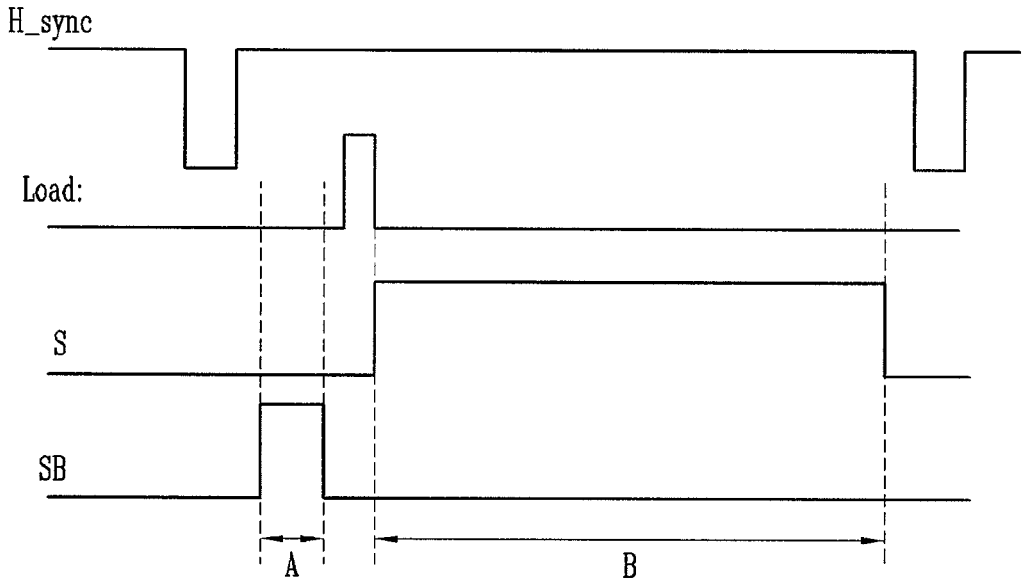
FIG. 5 is an operation timing diagram of a switch unit of the data driver of FIG. 4 according to an embodiment of the present invention.
Figure 6:
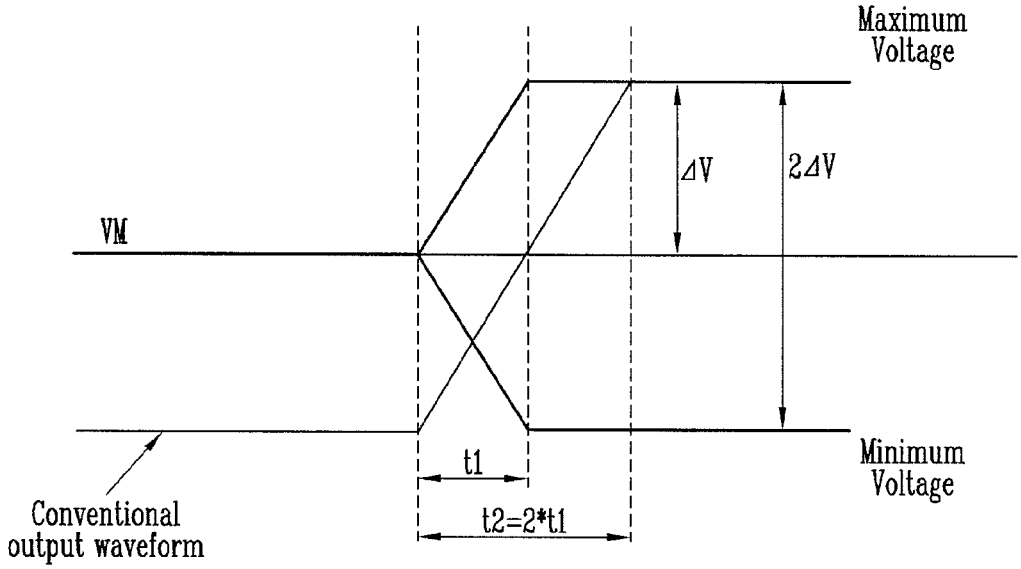
FIG. 6 is an output waveform diagram of the data driver of FIG. 4 according to an embodiment of the present invention.

FIG. 5 is an operation timing diagram of the switch unit of the data driver 300 of FIG. 4, and FIG. 6 is an output waveform diagram of the data driver 300 of FIG. 4.

Referring to FIG. 5, a first control signal SB that controls the operation of the first switch 362 is applied at a high level at the start time point of one line by a horizontal synchronization signal H_syn (A section), and the first switch 362 is turned on so that the output terminal of the output buffer is coupled to the source for providing the middle voltage VM. At this time, a second signal S that controls the operation of the second switch 364 is in a low-level state so that the second switch 364 is in a turn-off state.

After the output terminal of the output buffer is coupled to receive the middle voltage VM as described above, if a load signal is input as a start signal instructing the data signal to be output from the data driver, during the application of the subsequent horizontal synchronization signal, the first signal SB becomes a low level and a second signal S is applied at a high level (B section). Therefore, the first switch 362 is turned off and the second switch 364 is turned on so that the output terminals of the output buffers are coupled to the respective data lines corresponding thereto.

The respective output buffers previously charged with the middle voltage VM therethrough boost the middle voltage VM to the data voltage applied for each channel to output the data voltage to the data lines corresponding thereto.

In other words, referring to FIG. 6, in the data driver of the related art (conventional output waveform), when outputting the data voltage to the respective data lines, for example, in the case of full swing, power consumption and rising time are increased due to the variation of 2ΔV during the time of t2, whereas in the embodiment of the present invention (VM), the time rendered in being raised to the maximum voltage is reduced to t1(0.5*t2) by ½ compared to the related art and the voltage swing width is also reduced by ½ compared to the related art, thereby making it possible to reduce the slew rate as well as to reduce power consumption.

However, the middle voltage VM, which is ½ of the maximum swing voltage of the data voltage, is exemplarily implemented as middle voltage of the plurality of gray scale voltages explained through FIG. 3, wherein a method to set the middle voltage may have various suitable embodiments as described in more detail below.

That is, initially, the middle voltage VM may be implemented as ½ value of the sum of V0 that is the gamma voltage at 0 gray scale level (gray level) and V255 that is the gamma voltage at 255 gray scale level (gray level), among the plurality of gray scale voltages explained in FIG. 3, that is, middle voltage=½(V0+V255). Alternately, the middle voltage VM may also be implemented as ½ value of the uppermost level voltage VREGOUT that is the reference voltage of the ladder resistor 461 of FIG. 3.

In the embodiment of the present invention, in order to overcome the result that the size of the data driver becomes large when the calculated middle voltage VM is generated as a separate voltage and the limitation occurs in a driver IC layout, etc., as the separate voltage wirings cross the data driver, the middle voltage VM of an embodiment of the present invention is not separately generated but is generated from the middle voltage generator 450 using the gray scale voltage output from the gamma correction unit 400 as explained through FIG. 2 to be supplied to the data driver 300.

As such, in the embodiment of the present invention, the slew rate of the output buffer of the data driver can be reduced using a simple structure and/or method.

Also, there is another method that that can reduce the slew rate of the output buffer. In this other method, an average data for every 2 scan lines on the display panel, that is, average voltage, is obtained and it is set as the middle voltage that is coupled to the output terminals of the respective output buffers of the data driver when the data driver outputs the data signals applied to the respective pixels coupled to the scan lines.

However, in this other method, the slew rate of the output buffer is most reduced in term of the largeness of the display and the reduction in power consumption, but it is disadvantageous in terms of the complexity in the driver IC structure.

Therefore, an embodiment of the present invention proposes a method to set the middle voltage VM for effectively and economically reducing the slew rate and this embodiment of the present invention will be described in more detail with reference to FIG. 7.

Figure 7:
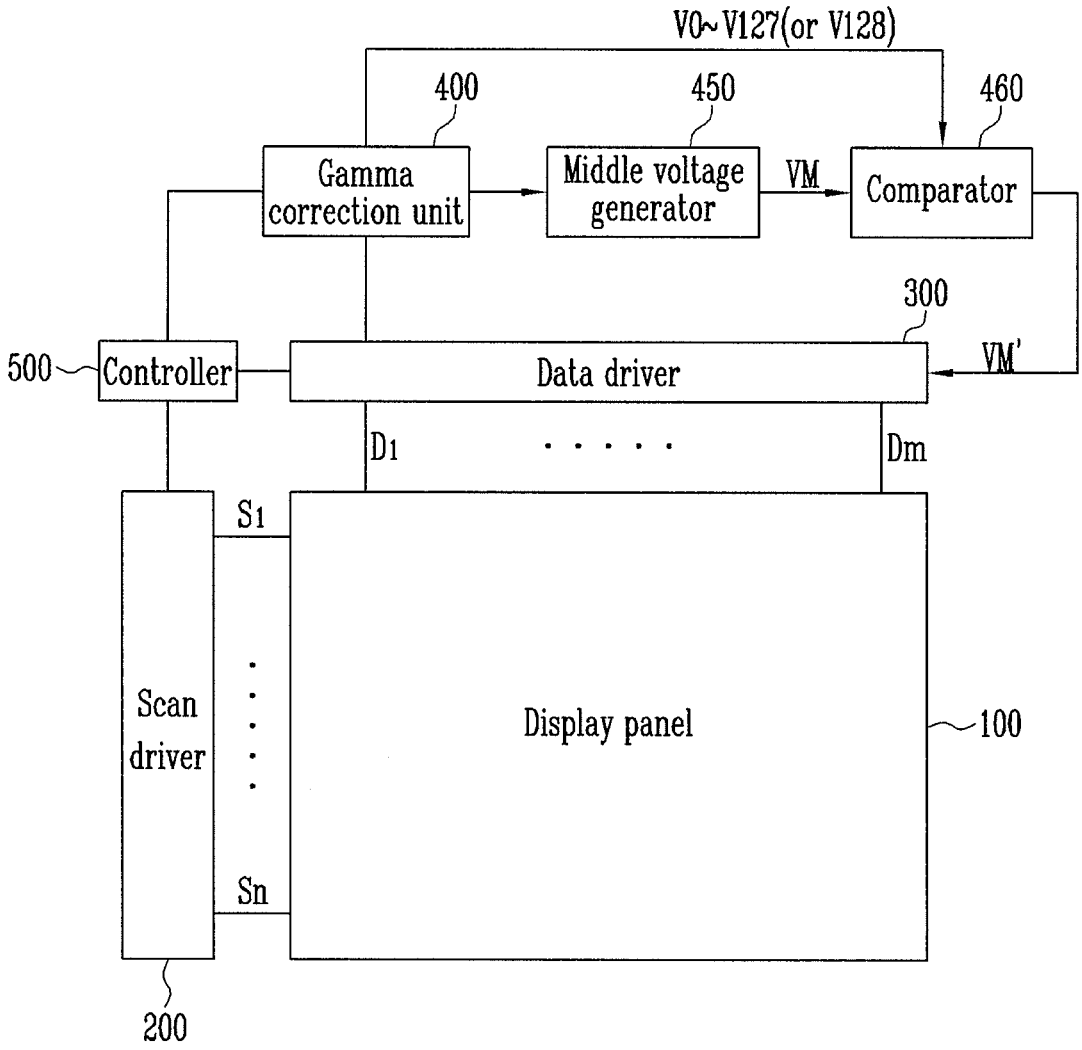
FIG. 7 is a perspective block diagram showing the constitution of an organic light emitting display according to another embodiment of the present invention.

FIG. 7 is a perspective block diagram showing the constitution of an organic light emitting display according to another embodiment of the present invention.

However, the description on the same constituents as those in the embodiment of FIG. 2 will not be provided again in detail.

Referring to FIG. 7, this present embodiment is different in that when supplying the middle voltage VM to the switch unit (360 in FIG. 4) of the data driver 300, the middle voltage VM generated from the middle voltage generator 450 is not supplied, but the middle voltage VM is compared with a middle gray scale voltage (for example, a 127 gray scale voltage or a 128 gray scale voltage in a 256 gray scale) of the gray scale voltages from 0 gray scale voltage to the entirety thereof, among the plurality of gray scale voltages output from the gamma correction unit 400, through a comparator 460 and the gray scale voltage closest to the middle voltage VM is selected to be provided as the middle voltage VM'.

In other words, the middle voltage VM' according to the embodiment of FIG. 7 is the gray scale voltage closest to the middle voltage VM generated from the middle voltage generator 450, among the gray scale voltage of V0 to V127 (or V128).

In view of the foregoing, first, if the gray scale voltages of V0 and V255 are generated from the gamma correction unit 400 as an optical condition such as brightness, etc. is determined, these are input to the middle voltage generator 450 to generate the middle voltage VM as the middle voltage of V0 and V255. The specific implementation method thereof is the same as the aforementioned.

Thereafter, the middle voltage VM and the gray scale voltages of V0 to V127 (or V128) are input to the comparator 460 so that the gray scale voltage closest to the middle voltage VM is selected to be provided to the switch unit of the data driver as the middle voltage VM' that is derived from the selected gray scale voltage that is finally corrected.

Here, the reason why the gray scale voltage input to the comparator 460 is limited to V0 to V127 (or V128) is that the middle voltage generally has a low gray scale voltage (at 127 or 128 gray scale level or less) in the characteristics of the gray scale having a curve of gamma 2.2.

Therethrough the middle voltage is automatically set even though the optical condition such as brightness, etc. is changed, making it possible to minimize the system components and/or the time for generating a separate middle voltage. Also, it is not required to generate the separate voltage, making it possible to prevent the increase in size of the data driver IC.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A data driver comprising:

an amplifier comprising respective output buffers corresponding to respective data lines, the respective output buffers being configured to output data signals to the respective data lines; and a switch unit between output terminals of the output buffers and the data lines corresponding thereto, wherein the switch unit comprises a first switch coupled between a source for providing a middle voltage and the output terminals; and a second switch coupled between the output terminals and the data lines, wherein the middle voltage is one half (½) of a maximum swing voltage of the data signals implemented as a plurality of gray scale voltages, wherein the middle voltage is implemented by comparing ½ of a sum of a first gray scale voltage of the gray scale voltages at a 0 gray scale level and a second gray scale voltage of the gray scale voltages at a maximum gray scale level, with a middle gray scale voltage of the gray scale voltages and selecting one of the gray scale voltages that is closest to the ½ of the sum of the first gray scale voltage at the 0 gray scale level and the second gray scale voltage at the maximum gray scale level.

2. The data driver as claimed in claim 1, further comprising:

a shift register unit configured to generate shift register clocks to provide sampling signals;

a sampling latch unit configured to sequentially store data in response to the sampling signals supplied sequentially from the shift register unit;

a holding latch unit configured to receive the data latched in the sampling latch unit and to store the latched data; and a digital-analog converter configured to generate the data signals as analog gray scale voltages corresponding to bit values of the data.

3. The data driver as claimed in claim 1, wherein the first switch is configured to be turned on before the data signals are output to the respective data lines so that the output terminals of the output buffers are coupled to receive the middle voltage, and the second switch is configured to be turned on when the data signals are output so that the output terminals of the output buffers are coupled to the data lines corresponding thereto.

4. The data driver as claimed in claim 1, wherein the middle voltage is ½ of a sum of a first gray scale voltage of the gray scale voltages at a 0 gray scale level and a second gray scale voltage of the gray scale voltages at a maximum gray scale level.

5. The data driver as claimed in claim 1, wherein the middle voltage is implemented as ½ value of an uppermost level voltage of a ladder resistor in a gamma correction unit.

6. The data driver as claimed in claim 1, wherein the middle voltage is implemented by comparing ½ of an uppermost level voltage of a ladder resistor in a gamma correction unit with a middle gray scale voltage of the gray scale voltages and selecting the gray scale voltage closest to the ½ of the uppermost level voltage.

7. An organic light emitting display comprising:

a display panel comprising a plurality of scan lines arranged to extend in a first direction and configured to transfer scan signals, a plurality of data lines arranged to extend in a second direction crossing the first direction and configured to transfer data signals, and a plurality of pixel circuits coupled to the scan lines and the data lines;

a data driver configured to generate the data signals and to apply them to the data lines;

a gamma correction unit configured to generate a plurality of gray scale voltages to provide them to the data driver; and a middle voltage generator configured to generate a middle voltage by selecting a specific gray scale voltage among the plurality of gray scale voltages output from the gamma correction unit, wherein the data driver comprises:

an amplifier comprising respective output buffers corresponding to the respective data lines, the respective output buffers being configured to output the data signals to the respective data lines; and a switch unit between output terminals of the output buffers and the data lines and is configured to receive a voltage corresponding to the middle voltage, wherein the middle voltage is one half (½) of a maximum swing voltage of the data signals implemented as the plurality of gray scale voltages, wherein the middle voltage is implemented by comparing ½ of a sum of a first gray scale voltage of the gray scale voltages at a 0 gray scale level and a second gray scale voltage of the gray scale voltages at a maximum gray scale level, with a middle gray scale voltage of the gray scale voltages and selecting one of the gray scale voltages that is closest to the ½ of the sum of the first gray scale voltage at the 0 gray scale level and the second gray scale voltage at the maximum gray scale level.

8. The organic light emitting display as claimed in claim 7, wherein the switch unit includes a first switch coupled between the middle voltage generator and the output terminals of the respective output buffers; and a second switch coupled between the output terminals of the respective output buffers and the respective data lines corresponding thereto.

9. The organic light emitting display as claimed in claim 8, wherein the first switch is configured to be turned on before the data signals are output to the respective data lines so that the output terminals of the output buffers are coupled to receive the middle voltage, and the second switch is configured to be turned on when the data signals are output so that the output terminals of the output buffers are coupled to the data lines corresponding thereto.

10. The organic light emitting display as claimed in claim 7, wherein the middle voltage generator is configured to select the gray scale voltage at 0 gray scale level and the gray scale voltage at a maximum gray scale level, among the plurality of gray scale voltages, to generate ½ of a sum thereof as the middle voltage.

11. The organic light emitting display as claimed in claim 7, further comprising:

a comparator configured to receive and compare the middle voltage generated from the middle voltage generator and a middle gray scale voltage of the gray scale voltages output from the gamma correction unit, to provide one of the gray scale voltages that is closest to the middle voltage to the data driver.

12. A data driver comprising:

an amplifier comprising an output buffer configured to output a data signal to a data line; and a switch unit between an output terminal of the output buffer and the data line, wherein the switch unit comprises a first switch coupled between a source for providing a middle voltage and the output terminal; and a second switch coupled between the output terminal and the data line, wherein the middle voltage is one half (½) of a maximum swing voltage of the data signals implemented as a plurality of gray scale voltages, wherein the middle voltage is implemented by comparing ½ of a sum of a first gray scale voltage of the gray scale voltages at a 0 gray scale level and a second gray scale voltage of the gray scale voltages at a maximum gray scale level, with a middle gray scale voltage of the gray scale voltages and selecting one of the gray scale voltages that is closest to the ½ of the sum of the first gray scale voltage at the 0 gray scale level and the second gray scale voltage at the maximum gray scale level.

13. The data driver as claimed in claim 12, wherein the first switch is configured to be turned on before the data signal is output to the data line so that the output terminal of the output buffer is coupled to receive the middle voltage, and the second switch is configured to be turned on when the data signal is output so that the output terminal of the output buffer is coupled to the data line.

* * * * *